United States Patent [19]

Ericsson

[11] Patent Number: 4,459,911

[45] Date of Patent: Jul. 17, 1984

[54] RAIL DESIGNED FOR USE IN THE CONSTRUCTION OF A STENCIL FRAME

[76] Inventor: Sylve J. D. Ericsson, Tolleus vås 8, 14700 Tumba, Sweden

[21] Appl. No.: 460,920

[22] Filed: Jan. 25, 1983

Related U.S. Application Data

[63] Continuation of Ser. No. 207,642, Nov. 17, 1980, abandoned.

[51] Int. Cl.[3] ..... B05C 17/08

[52] U.S. Cl. ..... 101/127.1

[58] Field of Search ..... 101/114–115, 101/121, 123, 124, 125, 126, 127–127.1, 128–128.1, 128.4; 40/152–152.1

[56] References Cited

U.S. PATENT DOCUMENTS

| | | | |
|---|---|---|---|
| 2,105,378 | 1/1938 | Smith | 101/124 |
| 2,637,269 | 5/1953 | Thomas | 101/123 |
| 2,713,821 | 7/1955 | Palczewski | 101/126 |
| 3,273,497 | 9/1966 | Rosema et al. | 101/128.1 |
| 3,422,554 | 1/1969 | Prinzhorn | 101/127.1 |
| 3,941,053 | 3/1976 | Black et al. | 101/127.1 |

*Primary Examiner*—Edgar S. Burr
*Assistant Examiner*—John A. Weresh
*Attorney, Agent, or Firm*—Burns, Doane, Swecker & Mathis

[57] ABSTRACT

A rail is designed to form a frame to which a stencil shall be secured in position. The frame complete with stencil secured in position is then being used in a screen printing machine. The rail is made from hollow-section profile. One of the walls of the profile is formed with a projection. The projection exhibits surfaces which face away from each other and which are designed to operate in conjunction with a holding device for the frame.

The frame is also designed in such a way that it can operate in conjunction with a second holding device.

10 Claims, 4 Drawing Figures

RAIL DESIGNED FOR USE IN THE CONSTRUCTION OF A STENCIL FRAME

This application is a continuation of application Ser. No. 207,642, filed Nov. 17, 1980 now abandoned.

TECHNICAL FIELD

The present invention relates to a rail of special cross-section and in particular to the type of rail designed to be used in the construction of a frame which is resistant to flexing. A screen or stenoil is attached to this frame, and the frame complete with stencil attached may then be used in a screen printing machine and held in position by means of holding devices for the frame which are part of the screen printing machine. The main purpose of this invention is to describe such a rail which may be manufactured in considerable lengths by means of an extrusion process, said rail then being cut to suitable lengths in order to produce the different component parts of the frame. The ends of the component parts of the frame should then be strengthened by welding at the corners.

Rails of the nature and for the purpose indicated above are usually made from perforated and grooved section in order to obtain a structure which is light in weight.

DESCRIPTION OF THE PRIOR ART

We are already familiar with a number of different rails, all made from perforated and grooved section and intended for use in the construction of a frame which is designed to hold a stencil securely in position. The frame is specially shaped so as to operate in conjunction with the holding device inside a screen printing machine.

The rails for this purpose with which we are already familiar vary in shape depending on the particular problem which it was intended to solve using rail of the section in question. Thus the section of the rail was usually shaped in an effort to facilitate the securing of the stencil, the fixing of the stencil to the rail and the fixing of the frame inside the screen printing machine.

DESCRIPTION OF THE PRESENT INVENTION

Technical Problem

Circumstances are known to exist in which the securing and attachment of a stencil to a frame subjects the frame to high stresses. The larger the frame and the stencil, the greater will be the stresses. The forces responsible for these stresses may be divided into two types, namely (a) the force which causes the frame to bow inwards towards the centre of the stencil in the same plane as the stencil;

(b) the force which produces a twisting moment which causes the frame to twist away from the plane of the stencil.

The effects of the stresses referred to above will be noticeable where the frame is made from a rail formed from perforated and grooved section (hollow-section profile), and the effect may even be so great in the case of certain hollow-section profiles that it will impair the correct functioning of the printing process inside the screen printing machine.

Thus a major problem encountered when constructing a frame of low weight from rail of hollow section is to achieve the smallest possible amount of inward bowing of the frame (as in point "a" above), at the same time as it is desirable for the effect produced by the twisting moment upon the frame (as in point "b" above) to be only small and preferably unnoticeable when the stencil is secured in position.

In order to keep down the total weight of the frame and the stencil when secured in position, it is desirable on the one hand for the rail to be of low weight per running meter, and on the other hand to avoid placing such demands on the stability of the assembly that the above disadvantages become noticeable.

One major wish associated with these frames for screen printing machines, particularly in view of the fact that the number of frame formats is extremely limited and is only a few in practice, was that the profile used for the rail should have adequate stiffness for it to be used even with large frames.

It should be noted in this context that the height dimension will usually be identical for all sizes of frame, but that the width may in principle be varied at will, although consideration must of course be given to the weight per running meter and to the anticipated inward bowing in accordance with point "a" above or to the effect of the twisting moment in accordance with point "b" above.

Solution

There now follows a description in accordance with the present invention of a rail designed to be used in the construction of a frame to which a stencil may be securely attached. The frame complete with the stencil secured in position may then be used in a screen printing machine. The rail consists of a hollow-section profile.

According to the present invention, at least one of the walls of the profile is formed with a projection. This projection exhibits surfaces which face away from each other and are designed to operate in conjunction with a holding device for the frame.

A further aim of the present invention is for the wall of one profile component to be formed with a projection and so arranged as to face away from the wall of a second profile component also formed with a projection when the two profile components are located one on either side of the stencil.

The projection is formed with two parallel surfaces so arranged as to run parallel with the stencil, but positioned so that both are located on one side (the top side) of the plane of the stencil.

The present invention also describes a possible means of causing the thickness of the wall in the vicinity of the projection to be greater than at other points on the rail. The thickness of the wall in the vicinity of surfaces which face away from eachother on the projection is greater than at other points on the rail, although not in the vicinity of the projection.

The present invention thus describes the possibility of providing the profile with points of varying thickness in order by so doing to produce a profile which has greater resistance to lateral flexing, at the same time as it comes within the scope of the description of the invention to give the hollow-section profile increased thickness of material at the top in order to compensate by so doing for the reduced width and to avoid any twisting of the profile due to the tensile forces applied by the stencil.

It has been found that a right angle between the upper and the outer sides of the frame components facilitates their location during welding and cutting to length. This arrangement also facilitates the adjustment to fit the holding device of the printing machine.

It is suggested that the surface should also be ridged or made uneven in some other way so as to provide a better key for the adhesive which is used to secure the stencil to the frame component.

Advantages

The advantages of a rail in accordance with the present invention are thus firstly that the rail has been given a geometric form such that it provides a high degree of resistance to the inward bowing of the frame component towards the centre of the stencil due to the tensile forces applied to the frame by the stencil, and that at the same time it has been found to provide a structure which will resist the twisting moment imposed by the tensile forces from the stencil to the frame.

It has also been found that the rail profile in accordance with the present invention enables the rail to operate in conjunction with the recently developed holding device for a special frame. This holding device is so designed that on the one hand it is not positioned beneath the stencil and on the other hand it is able to secure the frame component concerned in immediate contact with the stencil and in a plane which is only slightly displaced in relation to the plane of the stencil (so as to reduce the twisting moment). The rail profile also permits the rail to operate in conjunction with other types of holding device designed for older types of frame construction.

BRIEF DESCRIPTION OF THE DRAWINGS

A preferred embodiment indicating the significant characteristic features of the present invention is described in greater detail with reference to the attached drawing, in which.

DETAILED DESCRIPTION OF THE PREFERRED EMBODIMENT

Figure 1:
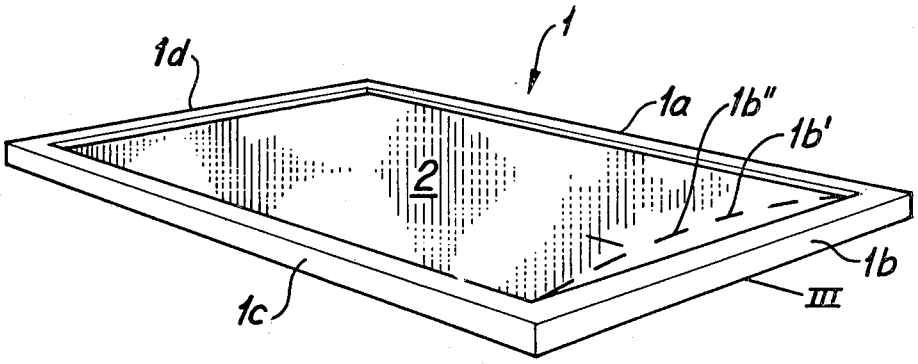
Fig. 1 (PRIOR ART)
FIG. 1 is a perspective view of a frame in which a stencil is secured in position.

With reference to FIG. 1, a frame 1 includes four components 1*a*, 1*b*, 1*c* and 1*d*, in which the frame components 1*a* and 1*c* are so arranged as to run parallel with each other and the frame components 1*b* and 1*d* are similarly arranged to run parallel with each other. The frame components are formed from one and the same rail, said rail having a profile of essentially rectangular cross-section with perforations and grooves. The profile of the rail is known as hollow-section profile.

A stencil 2 is secured in position on the rail components 1*a*–1*d* in such a way that the stencil is placed under tension and is subjected to tensile stresses, whereupon the frame components 1*a*–1*d* are permanently attached to the stencil by an adhesive. Once the stencil 2 has been secured in position (using an adhesive) on the frame components 1*a*–1*d*, the effect of the tensile stresses upon the stencil will cease, said forces being borne by the frame components 1*a*–1*d*.

Figure 3:
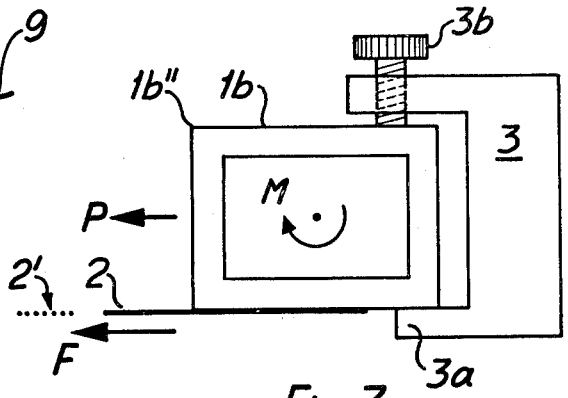
Fig. 3 (PRIOR ART)
FIG. 3 is a section along the line III—III through the frame structure in accordance with FIG. 1 in order to illustrate the forces which act upon the frame component with the stencil secured in position.

FIG. 3 illustrates how the forces to which the stencil 2 is being subjected have a tendency to displace the frame component 1*b* to the left. The arrow "F" has been used to indicate the force which is exerted on the frame component 1*b* by the securing in position of the stencil, and the arrow "P" indicates the displacement or inward bowing of the frame component 1*b* to the position 1*b*′ (FIG. 1) produced by the force "F". The force "F" also exerts an effect on the frame component 1*b* in the form of a twisting moment "M", which has a tendency to twist the middle portion of the frame component 1*b* in such a way that the point 1*b*″ has a tendency to rise upwards in FIG. 3.

A holding device 3 which forms part of the screen printing machine consists of a heel 3*a*, against which the frame components, for example 1*b*, rest together with a threaded screw 3*b* designed to operate on the upper surface of the frame component 1*b*. This holding device is of the old type.

The disadvantage of this holding device is that the component 3*a* will be located beneath the plane 2′ of the stencil 2.

Figure 2:
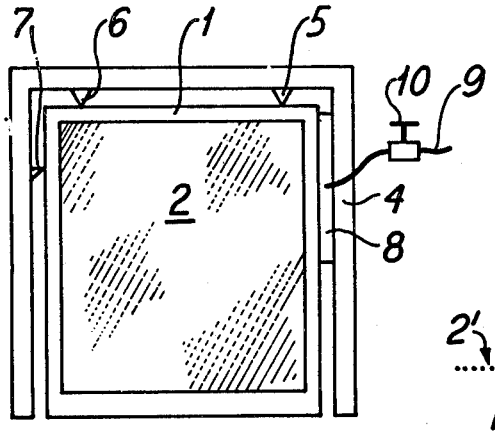
Fig. 2 (PRIOR ART)
FIG. 2 is a horizontal view of the frame in accordance with FIG. 1 held in a screen printing machine frame equipped with holding devices and register devices.

With reference to FIG. 2, a stencil 2, secured in position in a frame 1, must be capable of being registered rapidly in another frame 4, arranged in a screen printing machine. The actual screen printing machine does not appear in the attached drawing for reasons of simplicity. However the frame 4 does exhibit three register devices identified as 5, 6 and 7, against which the frame 1 may be adjusted; registering is done with the help of an inflatable hose 8 to which compressed air is supplied via a line 9 and a valve 10.

The activation of the flexible hose 8 will force the frame 2 into contact with the register devices 5–7.

Figure 4:
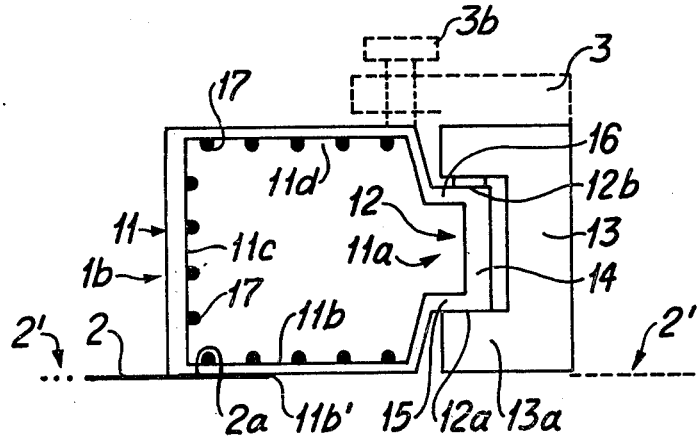
FIG. 4 is a section through a rail in accordance with the present invention.

FIG. 4 is a section through a rail as described in accordance with the present invention operating in conjunction with a different type of holding device to that shown in FIG. 3. This holding device for the frame is shaped in such a way that it will not extend beneath the plane 2′ of the stencil 2.

Thus the present invention describes a rail 11 designed for use in the construction of a frame, to which frame a stencil 2 may be secured in position. The frame complete with stencil secured in position may then be used in a screen printing machine. The rail is made from a special hollow-section profile, which is described in more detail below.

The rail in accordance with the present invention consists of a wall 11*a*, formed with a projection 12, which is smaller in size than the rest of the wall 11*a*. A second wall 11*b*, forming a right angle with the first wall, is designed to hold the stencil 2 in position. A third wall 11*c*, forming a right angle with the second wall 11*b*, thus faces towards the centre of the stencil 2. A fourth wall 11*d*, forming a right angle with both the third wall 11*c* and the first wall 11*a*, is designed to be capable of operating in conjunction with a holding device 3 of familiar construction (FIG. 3) and is designed particularly for a type of rail profile other than that in accordance with the present invention.

In accordance with the present invention at least one of the walls of the profile 11 shall be formed with a projection 12 and the projection shall exhibit surfaces 12*a*, 12*b* which face away from each other, designed to be capable of operating in conjunction with a first holding device 13 for the frame 1. The wall of a first profile component 1*b*, formed with a projection, is so arranged as to face away from the wall of a second profile component 1*d*, formed with a projection, when the two profile components 1*b* and 1*d* are located one on either side of the stencil 2.

The projection 12 is formed with two parallel surfaces 12*a* and 12*b*, said surfaces also being arranged so as to run parallel with the plane 2' of the stencil 2, although displaced in such a way that both surfaces of the projection 12 are located on one side of the stencil 2.

The outer surface 11*b'* of the second wall 11*b* is ridged so as to provide a better key for a layer of adhesive 2*a* used to secure the stencil 2 to the frame 11.

The wall thickness in the vicinity of the projection 12 and of the part which is identified as 14 is greater than the wall thickness in other parts of the profile.

The wall thickness in the vicinity of the surfaces 12*a* and 12*b* which face away from each other at the projection and which are identified as 15 and 16 is greater than in other parts of the profile, although not in the vicinity of the projection 12 and the component 14. The third wall 11*c* has a thickness which exceeds the thickness of the second 11*b* and fourth 11*d* walls, and is essentially the same as the thickness of the walls 15 and 16.

The wall 11*d*, which is located away from the wall 11*b* which holds the stencil 2 in position, is designed so as to be capable of operating in conjunction with a second holding device 13 for the frame.

The distance from the wall 11*b* designed to hold the stencil 2 in position to the surface 12*a* closest to the projection 12 is equal to or greater than the thickness of the holding device in the vicinity of the component 13*a*.

Thus the entire holding device will be located above the plane of the stencil 2.

It may also be seen from FIG. 4 that the insides of the walls 11*b*, 11*c*, 11*d* are formed with a number of ridges 17, designed partly to stiffen the rail profile and partly to help maintain dimensional stability when the profile is being manufactured from aluminium, magnesium or a similar material by means of an extrusion process.

The invention is not, of course, limited to the typical embodiment described above, but may undergo modification within the context of the following Patent Claims.

What is claimed is:

1. A rail for forming a frame to which a stencil is to be secured in position, said frame complete with the stencil secured in position being in a screen printing machine, said rail comprising a constant hollow-section profile defined by four walls, at least one of the walls of the profile being formed with a hollow projection generally centrally located thereon, said projection including two substantially parallel surfaces arranged on corresponding projection walls which extend generally perpendicular to the at least one wall, exterior sides of said surfaces facing in opposite directions from each other, said surfaces being arranged to cooperate with a holding device for the frame, ends of said projection walls remote from the at least one wall being interconnected by an additional projection wall which is substantially perpendicular to the projection walls.

2. The rail in accordance with claim 1, wherein the projection on the wall is arranged to face in a direction opposite from a projection on a wall of a second rail when the two rails are located on opposite sides of the stencil.

3. The rail in accordance with claim 1, wherein the two surfaces of the projection are parallel to one another and are arranged parallel with the stencil, both of said surfaces being located on the same side of the stencil.

4. The rail in accordance with claim 1, wherein an outer surface of one of the walls adjacent the wall having the projection is ridged to provide a key for a layer of adhesive adapted for holding the stencil.

5. The rail in accordance with claim 1, wherein the thickness of the additional projection wall which interconnects the walls carrying the surfaces of the projection is greater than the thickness of the projection walls carrying the two surfaces.

6. The rail in accordance with claim 1, wherein the thickness of the projection walls carrying the surfaces is greater than the thickness of the walls defining the hollow section profile.

7. The rail in accordance with claim 1, wherein two walls of the profile adjacent the wall having the projection are adapted to cooperate with a second holding device for the frame, one of the two walls being adapted to hold the stencil in position.

8. The rail in accordance with claim 1, wherein the profile includes a first wall having the projection which extends only partially along a length of the first wall, a second wall, forming a right angle with the first wall, and being adapted to hold the stencil, a third wall forming a right angle with the second wall, and a fourth wall forming a right angle with the third wall, said second and fourth walls being adapted to cooperate with a second holding device for the frame.

9. The rail in accordance with claim 1, wherein the distance from one wall adapted to hold the stencil in position to one of the surfaces closest to the stencil is equal to or greater than a thickness of a portion of the holding device of the frame closest to the stencil.

10. The rail in accordance with claim 8, wherein the third wall has a thickness which is greater than the thickness of the second and fourth walls.

* * * * *